US005149380A

United States Patent [19]

Decker

[11] Patent Number: 5,149,380

[45] Date of Patent: Sep. 22, 1992

[54] PURGING PROCESS FOR MULTICOMPONENT REACTIVE LIQUID DISPENSING DEVICE

[76] Inventor: Fredric H. Decker, 3423 S.E. Jefferson St., Stuart, Fla. 34997

[21] Appl. No.: 685,984

[22] Filed: Apr. 15, 1991

Related U.S. Application Data

[63] Continuation of Ser. No. 304,729, Jan. 31, 1989, abandoned.

[51] Int. Cl.[5] ..... B08B 3/02; B08B 5/02

[52] U.S. Cl. ..... 134/22.13; 134/22.19; 134/42; 134/94.1; 134/95.1

[58] Field of Search ..... 134/22.18, 22.19, 42, 134/94, 95

[56] References Cited

U.S. PATENT DOCUMENTS

| | | | |
|---|---|---|---|
| 4,002,271 | 1/1977 | Bulk | 222/148 |
| 4,119,110 | 10/1978 | Stone | 222/148 |
| 4,285,446 | 8/1981 | Rapp et al. | 222/148 |
| 4,426,023 | 1/1984 | Sperry et al. | 222/148 |
| 4,471,887 | 9/1984 | Decker | 222/148 |
| 4,523,696 | 6/1985 | Commette et al. | 222/148 |
| 4,801,335 | 1/1989 | Burkman et al. | 134/25.4 |

*Primary Examiner*—Asok Pal

*Attorney, Agent, or Firm*—Marshall & Melhorn

[57] ABSTRACT

The mixing chamber, liquid reactant injection nozzle, and dispensing pathway of a multicomponent reactive liquid dispensing device are purged of unwanted residual reaction products, by performing at least two cycles of an operation in which a liquid solvent and pressurized gas are sequentially injected into the mixing chamber, followed by a stream of pressurized gas to dry the purged device.

14 Claims, 1 Drawing Sheet

PURGING PROCESS FOR MULTICOMPONENT REACTIVE LIQUID DISPENSING DEVICE

This application is a continuation of U.S. patent application Ser. No. 07/304,729, filed Jan. 31, 1989 and now abandoned.

FIELD OF THE INVENTION

This invention relates generally to processes for purging dispensing devices, and more particularly, to a process for purging the mixing chamber of a multicomponent reactive liquid dispensing device such as is used for dispensing a hardenable polyurethane reactive liquid mixture.

BACKGROUND OF THE INVENTION

It is well known in the art to prepare plastic and synthetic foam articles from polyurethanes, polyesters, epoxies, vinyl esters, polyamides, and the like, by combining two or more liquid organic reactive components, and thereafter injecting the reactive mixture into a mold cavity where the mixture cures and hardens into a finished plastic product. A particular problem associated with the handling, mixing, and dispensing of liquid reactive components is the tendency of the components to react rapidly with each other or upon exposure to the atmosphere, thereby causing the accumulation of undesirable reaction products within the mixing and dispensing device. These accumulations interfere with the thorough mixing and dosing of precise amounts of the reactive mixture, by restricting the mixing chamber and dispensing passageway at any or all points downstream from where the individual reactive components enter the mixing chamber. This problem is particularly severe when the dispensing device is used intermittently.

Several systems have been devised for purging unwanted reaction products from dispensing devices. U.S. Pat. No. 4,523,696 discloses the use of a reciprocating valve rod or plunger which, when located in a forward position, occupies the mixing chamber sealing the inlet ports of the liquid reactants, and, when located in a rearward position, opens the mixing chamber permitting the flow of liquid reactants into the mixing chamber. After the appropriate amount of liquid reactant mixture has been dispensed, the reciprocating valve rod is moved from its rearward to its forward position, thereby preventing the flow of individual reactants into the mixing chamber, and sweeping through the mixing chamber to mechanically expel the remaining liquid reactants therefrom. The patent discloses washing the reciprocating valve rod with one of the liquid components to prevent its binding during movement into and out from the mixing chamber, due to the accumulation of unwanted reaction products on the surface thereof. U.S. Pat. No. 4,471,887 additionally discloses the introduction of purging air into the mixing chamber when the reciprocating rod is in the rearward position.

U S. Pat. No. 4,285,446 discloses a multicomponent dispensing apparatus, wherein polyurethane foam reactants are combined in a mixing chamber, followed by the injection into the mixing chamber of a purging gas, such as pressurized air, for a predetermined time interval, thus purging the unwanted reaction products and readying the apparatus for dispensing another "shot" of the liquid reactant mixture.

Several purging processes utilize a solvent, which is admitted to the mixing chamber to dissolve and flush undesired reaction products and unreacted liquid components from the mixing chamber via the dispensing passageway or an exhaust port. U.S. Pat. Nos. 4,002,271; 4,426,023; and 4,516,694 disclose injecting a pressurized solvent directly into the mixing chamber or the dispensing port, to solubilize and flush accumulated deposits of unwanted reaction products, U.S. Pat. No. 4,440,320 discloses a rotary valve which oscillates between a first position in which the valve passageways communicate with channels supplying the liquid reactants, and a second position in which the valve passageways communicate with channels supplying a cleaning solution to the mixing chamber.

Finally, U.S. Pat. No. 4,033,481 discloses a liquid polyester resin and catalyst mixing and dispensing device, having a solvent port for admitting an air atomized stream of acetone or methylene chloride to the mixing chamber. The injection of atomized solvent is followed by a continuous stream of pressurized air, to dry the chamber and dispensing passageway. The solvent is atomized at a point at least eight to ten feet from the mixing chamber and conveyed to the chamber by means of a conduit, thereby insuring that non-atomized liquid does not enter the mixing chamber. The singular atomization, flushing, and drying cycle requires only a few seconds.

SUMMARY OF THE INVENTION

Accordant with the present invention, it has surprisingly been discovered that unwanted deposits of reaction products may effectively and easily be removed from the mixing chamber, reactive liquid injection ports, and dispensing pathway of a multicomponent reactive liquid dispensing device, by a novel process comprising the steps of:

A) purging the residual reaction products, by performing at least two cycles of the sequential steps of:

i) injecting a liquid solvent into the mixing chamber; and ii) injecting a pressurized gas into the mixing chamber; and B) drying the mixing chamber, liquid reactant injection ports, and dispensing pathway, by injecting pressurized gas into the mixing chamber.

The process of the present invention is particularly useful for eliminating unwanted residual reaction products, which accumulate in the mixing chamber, reactive liquid injection ports, and dispensing devices used for reaction injection molding, resin transfer molding, and in polyurethane foam guns.

BRIEF DESCRIPTION OF THE DRAWING

The novel features that are considered characteristic of the invention are set forth with particularity in the appended claims. The invention itself, however, will best be understood by the accompanying description of specific embodiments, when read in connection with the attendant drawing, in which

DETAILED DESCRIPTION OF THE PREFERRED EMBODIMENT

Figure 1:
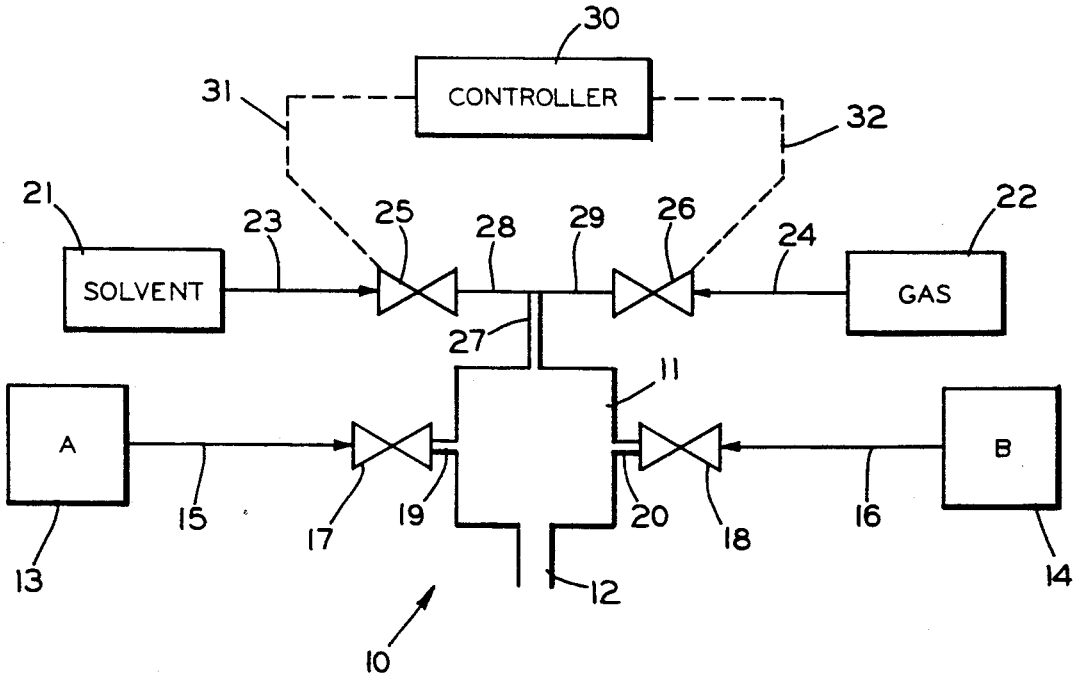
FIG. 1 is a schematic representation of an apparatus useful for practicing a process embodying the novel features of the present invention.

Referring now to FIG. 1, there is shown a multi-component reactive liquid dispensing device, illustrated generally at 10, comprising a mixing chamber 11, and a dispensing pathway 12. The dispensing pathway 12 may conveniently be open to the atmosphere, or connected to a mold cavity (not shown). The mixing chamber 11 is adapted to receive a plurality of reactive liquids from reactive liquid reservoirs, of which two are shown at 13 and 14. The reactive liquids are pressurized by any conventional method known in the art, such as for example by pressurizing the vapor space within the reactive liquid reservoirs 13 and 14. Reservoirs 13 and 14 communicate via transfer lines 15 and 16, respectively, with supply valves 17 and 18, respectively, which in turn communicate with injection ports 19 and 20. respectively, opening into the mixing chamber 11. A reactive liquid contained in one of the reservoirs 13 or 14 may thereby be admitted to the mixing chamber 11, by opening the appropriate supply valve 17 or 18, allowing flow therethrough by way of the associated transfer line 15 or 16 and injection port 19 or 20.

In the conventional manufacturing processes where multicomponent reactive liquid dispensing devices are used, such as for example reaction injection molding, resin transfer molding, and especially polyurethane foaming processes, at least two reactive liquids are combined in a device 10 such as is shown in FIG. 1 to form a hardenable reactive liquid mixture. The reactive liquids, represented as component A and component B, are combined within the mixing chamber 11 by intimately contacting each other through what is known in the art as turbulent or impingement mixing. The mixed reactive liquids A and B immediately begin to react together, or cure, ultimately into a hardened configuration. The mixed reactive liquids are expelled from the mixing chamber 11 through the dispensing pathway 12 by the pressure generated in the mixing chamber 11, caused by the injection of the liquids, and the autogenous pressure incident to the chemical reaction. Typically, mixed liquid reactants are dispensed in discrete portions or "shots." Between successive shots, the liquid reactants, which remain adhered to the walls of the mixing chamber 11 and dispensing pathway 12, react together or individually with air in the atmosphere, to form accumulations of unwanted reaction products. This residual accumulation builds over a period of time and eventually restricts the mixing chamber 11, dispensing pathway 12, and injection ports 19 and 20, thereby interfering with the turbulent or impingement mixing process which affects the integrity of the ultimately formed plastic article.

Generally, the liquid reactants utilized in multicomponent reactive liquid dispensing devices are those which produce polyurethanes, polyesters, epoxies, vinyl esters, polyamides, and the like. Polyurethane producing liquid reactants are preferred, and typically comprise isocyanates, such as for example methylene diisocyanate and toluene diisocyanate, and polyols, which preferably are either polyether polyols or polyester polyols, Generally, the polyurethane liquid reactants also include chain extenders and curing agents, such as for example diamine compounds either alone or in various blends. Other suitable liquid reactants include crosslinkable polyester and epoxy resins, and their associated crosslinking catalysts. The polyester liquid reactants generally comprise unsaturated polyester resins dissolved in a polymerizable ethylenically unsaturated monomer, such as for example styrene, and a liquid initiator. Useful epoxy liquid reactants generally comprise ethers containing the epoxide group, and aliphatic polyols containing amine catalysts. The liquid reactants may additionally contain conventional polymeric adjuvants, such as for example blowing agents, fillers, thermal stabilizers, dyes, flame retardants, pigments, plasticizers, antistatic agents, lubricants, etc.

After a number of shots of mixed liquid reactants have been dispensed, the mixing chamber 11, dispensing pathway 12, and injection ports 19 and 20 generally become fouled by residual reaction products. These are removed by purging the accumulations using at least two cycles of a sequential operation in which a liquid solvent is injected into the mixing chamber 11, and thereafter a pressurized gas is injected into the mixing chamber 11. During those portions of the purging cycles in which the pressurized gas is being injected into the mixing chamber, the liquid solvent does not completely evaporate. A portion of the solvent remains, to continue loosening and dissolving the residual reaction products throughout the purging operation.

The solvent and gas are supplied from reservoirs 21 and 22, respectively, at a pressure above the static pressure of the mixing chamber 11. Desirably, the pressure is from about 25 to about 250 pounds per square inch gage, and preferably, the pressure is from about 90 to about 140 pounds per square inch gage. The solvent and gas supplies may be pressurized by any conventional method known in the art, such as for example by pumping the liquid solvent or pressuring the solvent reservoir 21, and by compressing the gas in the gas reservoir 22. The solvent and gas reservoirs 21 and 22, respectively, communicate by means of transfer lines 23 and 24, respectively, with control valves 25 and 26, respectively, which in turn communicate with an injection nozzle 27 via connectors 28 and 29, respectively. The injection nozzle 27 opens into the mixing chamber 11. Solvent or gas may be admitted to the mixing chamber by opening the appropriate control valve 25 or 26, allowing flow therethrough by way of the associated transfer lines 23 and 25, respectively, the associated connectors 28 and 29, respectively, and finally the injection nozzle 27.

Control valves 25 and 26 are independently operated by a controller 30, which is adapted to deliver an electrical, pneumatic, or other signal through signal transmission means 31 and 32, respectively. A signal from the controller 30 causes either valve 25 or 26 to open, permitting flow therethrough of a solvent or pressurized gas, respectively, A different signal from controller 30 causes either of the valves 25 or 26 to close. The signals are received, via signal transmission means 31 or 32, by valve operators (not shown) which convert the signals to mechanical motion for opening or closing the valves 31 or 32 through conventional means, such as an electrical solenoid or pneumatically operated diaphragm. The controller 30 may comprise any conventional programable control mechanism generally known in the art for signaling the opening and closing of hydraulic valves at discrete time intervals, such as for example a programable controller, mechanical or electrical timer, time delay relays, etc.

In operation, the purging process for removing accumulations of reaction products from the mixing chamber 11, dispensing pathway 12, and injection ports 19 and 20, is carried out while the liquid reactant supply valves 17 and 18 remain in their closed positions. A sequence of signals previously programed into the controller 30 is begun, and a series of cycles for opening and closing the solvent and Pressurized gas control valves 25 and 26, respectively, is initiated.

A cycle, as the term is defined herein, begins with the opening of the solvent control valve 25 for a first predetermined period of time, thereby allowing the injection of liquid solvent into the mixing chamber 11 through nozzle 27. During this time period, the pressurized gas control valve 26 remains closed. After a quantity of solvent is injected, the controller 30 causes the solvent control valve 25 to close, and simultaneously causes the pressurized gas control valve 26 to open, thereby allowing the injection of Pressurized gas into the mixing chamber 11 through nozzle 27. The pressurized gas control valve 26 remains open, and the solvent control valve 25 remains closed, for a second predetermined time period, after which the pressurized gas control valve 26 closes thereby completing the cycle. The liquid solvent, which was previously injected, is not completely evaporated by the blast of pressurized gas. A portion of the solvent remains in the mixing chamber at all times during the purging cycle, to soften and/or dissolve the residual reaction products. The liquid solvent is injected into the mixing chamber for a duration from about 0.1 second to about 5.0 seconds; preferably, the duration is from about 0.2 second to about 1.0 second. The pressurized gas is injected for a duration from about 0.1 second to about 10.0 seconds; preferably, the duration is from about 0.2 second to about 4.0 seconds.

At least two cycles, and preferably up to about 15 cycles, are completed, after which the controller 30 causes the pressurized gas control valve 26 to open, and thereby dry the purged mixing chamber 11, dispensing pathway 12, and injection ports 19 and 20. Most preferably, 2 to about 5 purging cycles are utilized, before commencing the drying operation. By drying is meant the evaporation of residual solvent.

It will be appreciated that the controller 30 may be programed to provide virtually any duration for the first and second time periods, during which liquid solvent and pressurized gas, respectively, are injected into the mixing chamber 11. Additionally, the first and second time periods may be programed to vary during consecutive cycles of the purging operation. The first time period, during which liquid solvent is injected into the mixing chamber, may be varied within the time period from about 0.1 second to about 5.0 seconds, and the second time period, during which pressurized gas is injected into the mixing chamber, may be varied within the time period from about 0.1 second to about 10.0 seconds. Likewise, the drying time may be varied, depending on the evaporation rate of the particular solvent used. Generally the drying operation requires from about 1.0 second to about 30 seconds. Preferably, the drying operation is carried out from about 2.0 seconds to about 10.0 seconds.

Desirably, the material injected into the mixing chamber 11 alternates rapidly between liquid solvent and pressurized gas, thereby causing considerable turbulence and scrubbing action within the mixture chamber 11, dispensing pathway 12, and injection ports 19 and 20.

The use of a liquid, rather than atomized or vaporized solvent, enhances the cleaning action due to the inertial impacting of the residue by the liquid solvent mass. The residual reaction products, as well as the solvent and gas, are expelled from the mixing chamber 11, dispensing pathway 12, and injection ports 19 and 20, through the discharge of the dispensing pathway 12.

Suitable solvents for use according to the present invention are those solvents commonly known in the art for penetrating and/or dissolving multicomponent reactive liquid dispensing device polymeric precursors, and their unwanted residual reaction products. Examples include, but are not limited to, aromatic hydrocarbons, such as for example, benzene, toluene, and xylene, halogenated hydrocarbons, such as for example carbon tetrachloride, chlorobenzene, chloroform, trichloromethane, and methylene chloride, cyclic hydrocarbons, such as for example cyclohexane, as well as esters, ethers, ketones, and amines. A preferred solvent is methylene chloride.

Suitable pressurized gases for use according to the present invention include, but are not limited to, air, nitrogen, carbon dioxide, and the like. A preferred pressurized gas is compressed air.

The process described hereinabove is generally disclosed in terms of its broadest application to the practice of the invention. Occasionally, however, the compounds as described may not be applicable to each phase of the process included within the disclosed scope. Those compounds for which this occurs will be readily recognized by those skilled in the art. In all such cases, the process may be successfully performed by conventional modifications known to those skilled in the art, e.g., by substituting appropriate solvents, or by routine modifications of the purging and drying cycle durations.

While certain representative embodiments and details have been shown for purposes of illustrating the present invention, it will be apparent to those ordinarily skilled in the art that various changes in applications can be made therein, and that the invention may be practiced otherwise than as specifically illustrated and described without departing from its spirit and scope. For example, the liquid solvent and pressurized gas may be injected into the mixing chamber through separate nozzles, or the injection location and relative orientation may be varied to provide enhanced scrubbing action within certain areas of the mixing chamber, dispensing pathway, and liquid reactant injection ports, which are prone to excessive accumulations of unwanted reaction products.

EXAMPLE

The liquid reactant supply valves of a multicomponent reactive liquid dispensing device utilizing a liquid isocyanate and liquid polyol to produce a foamed polyurethane, are closed. A controller is activated, which causes the rapid sequenced injection of liquid methylene chloride and compressed air into the mixing chamber of the device, through a single injection nozzle. The injection pressures for the liquid methylene chloride and compressed air are maintained between about 100 psig and about 120 psig. Three consecutive purge cycles, consisting of injections of methylene chloride lasting for about 0.5 second and injections of compressed air lasting for about 1.5 seconds. are used to completely remove residual reaction products from the mixing chamber, liquid reactant injection ports, and dispensing pathway. The purging operation is followed by the injection of compressed air into the mixing chamber for a period of about 10 seconds, to completely dry the purged mixing chamber, liquid reactant injection ports, and dispensing pathway. A total of about 100 g of methylene chloride is used.

What is claimed is:

1. A device for removing residual reaction products from the mixing chamber of a multicomponent reactive liquid dispensing device, comprising:

A) means for injecting a liquid solvent into the mixing chamber;

B) means for injecting a pressurized gas into the mixing chamber;

C) means for controlling the cycling of the injection of liquid solvent into the mixing chamber by said means for injecting a liquid solvent; and D) means for controlling the cycling of the injection of pressurized gas into the mixing chamber by said means for injecting a pressurized gas, whereby said means for controlling the injection of liquid solvent and said means for controlling the injection of pressurized gas operate so that at least two cycles of the sequential steps of i) injecting a liquid solvent into the mixing chamber for a predetermined duration, and ii) injecting a pressurized gas into the mixing chamber for a predetermined duration are performed, followed by the injection of pressurized gas into the mixing chamber for a predetermined duration sufficient to dry the mixing chamber.

2. A device for removing residual reaction products as defined in claim 1, wherein said means for controlling the timing and duration of the injection of pressurized gas controls said means for injecting a pressurized gas so that each injection of pressurized gas begins substantially simultaneously with the completion of the injection of liquid solvent in step i of a each cycle.

3. A device for removing residual reaction products as defined in claim 1, wherein said means for controlling the timing and duration of the injection of pressurized gas controls said means for injecting a pressurized gas so that each injection of pressurized gas is for a duration less than that required to completely evaporate the liquid solvent injected into the mixing chamber in step i of a each cycle.

4. A device for removing residual reaction products as defined in claim 3, wherein said means for controlling the timing and duration of the injection of liquid solvent controls said means for injecting a liquid solvent so that each injection of liquid solvent is for a duration of from about 0.1 second to about 5.0 seconds.

5. A device for removing residual reaction products as defined in claim 3, wherein said means for controlling the timing and duration of the injection of pressurized gas controls said means for injecting a pressurized gas so that each injection of pressurized gas is for a duration of from about 0.1 second to about 10.0 seconds.

6. A device for removing residual reaction products as defined in claim 3, wherein said means for controlling the injection of liquid solvent and said means for controlling the injection of pressurized gas operate to perform from 2 to 15 cycles of the sequential steps i and ii.

7. A process for removing residual reaction products from the mixing chamber, liquid reactant injection ports, and dispensing pathway of a multicomponent reactive liquid dispensing device, comprising the steps of:

A) purging the residual reaction products, by performing at least two consecutive cycles of the sequential steps of:

i) injecting a liquid solvent into the mixing chamber and inertially impacting the reaction product residue with the liquid solvent mass for about 0.1 seconds to about 5 seconds; and ii) injecting a pressurized gas into the mixing chamber, beginning substantially simultaneously with the completion of the injection of liquid solvent in step i and expelling from the chamber impacted reaction product residue, solvent and gas for about 0.1 seconds to 10 seconds; and B) drying the mixing chamber, liquid reactant injection ports, and dispensing pathway, by injecting pressurized gas for about 1 second to 30 seconds into the mixing chamber.

8. A process for removing residual reaction products according to claim 7, wherein the injection of pressurized gas in step Aii is for a duration less than that required to completely evaporate the liquid solvent injected into the mixing chamber in step Ai.

9. A process for removing residual reaction products according to claim 7, wherein the injection of pressurized solvent in step Ai is for a duration from about 0.2 second to about 1.0 seconds.

10. A process for removing residual reaction products according to claim 7, wherein the injection of pressurized gas in step Aii is for a duration from about 0.2 second to about 4.0 seconds.

11. A process as defined in claim 7 in which step Ai is for about 0.5 seconds and step Aii is about 1.5 seconds.

12. A process as defined in claim 11 in which the drying step B is for about 10 seconds.

13. A process as defined in claim 11 in which step A is performed in three consecutive cycles.

14. A process as defined in claim 11 in which the consecutive cycles are from two to fifteen.

* * * * *